US008342165B2

(12) United States Patent
Watkins

(10) Patent No.: US 8,342,165 B2
(45) Date of Patent: Jan. 1, 2013

(54) APPLIANCE WITH A VENTURI BASED VENTING SYSTEM

(75) Inventor: Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 727 days.

(21) Appl. No.: 12/328,268

(22) Filed: Dec. 4, 2008

(65) Prior Publication Data

US 2010/0139640 A1 Jun. 10, 2010

(51) Int. Cl.

| | |
|---|---|
| ***F24C 15/32*** | (2006.01) |
| ***F24C 15/00*** | (2006.01) |
| ***F24C 15/34*** | (2006.01) |
| ***F24B 5/08*** | (2006.01) |
| ***A47J 37/06*** | (2006.01) |

(52) U.S. Cl. ..... 126/21 A; 126/1 R; 126/19 R; 126/21 R; 126/273 R; 126/273.5; 126/275 E

(58) Field of Classification Search ..... 126/1 R, 126/19 R, 21 A, 21 R, 273 R, 273.5, 275 E
See application file for complete search history.

(56) References Cited

U.S. PATENT DOCUMENTS

| | | | | |
|---|---|---|---|---|
| 3,659,579 | A * | 5/1972 | Henderson et al. | 126/21 A |
| 3,921,617 | A * | 11/1975 | Rumbaugh | 126/21 R |
| 4,331,124 | A | 5/1982 | Seidel et al. | |
| 4,592,333 | A * | 6/1986 | Dustin | 126/21 R |
| 4,971,023 | A | 11/1990 | Martinez | |
| 5,727,539 | A * | 3/1998 | Vroom | 126/21 A |
| 6,913,012 | B2 * | 7/2005 | Divett et al. | 126/21 A |
| 6,967,310 | B2 * | 11/2005 | Austin et al. | 219/408 |
| 2003/0037780 | A1 * | 2/2003 | Wiersma et al. | 126/21 R |
| 2003/0079736 | A1 * | 5/2003 | Franzolin et al. | 126/21 A |
| 2008/0110879 | A1 * | 5/2008 | Marchand | 219/757 |
| 2008/0185373 | A1 * | 8/2008 | Elkasevic et al. | 219/394 |
| 2009/0183723 | A1 * | 7/2009 | Hasslberger et al. | 126/21 A |

FOREIGN PATENT DOCUMENTS

| | | |
|---|---|---|
| EP | 1457740 | 9/2004 |
| GB | 1336851 | 11/1973 |

* cited by examiner

*Primary Examiner* — Kenneth Rinehart
*Assistant Examiner* — William Corboy
(74) *Attorney, Agent, or Firm* — Global Patent Operation; Douglas D. Zhang

(57) ABSTRACT

An appliance with a Venturi based venting system is disclosed. The appliance includes a housing defining an airflow channel in flow communication with outside of the appliance, the airflow channel having a common channel with a diverging section; first and second heating units disposed in the housing; a first duct through which a first cavity of the first unit is in flow communication with the common channel, the first duct having a first outlet end disposed at least partially in the diverging section; a second duct through which a second cavity of the second unit is in flow communication with the common channel, the second duct having a second outlet end disposed in the diverging section; and a fan in flow communication with the common channel.

14 Claims, 9 Drawing Sheets

APPLIANCE WITH A VENTURI BASED VENTING SYSTEM

BACKGROUND OF THE INVENTION

The present invention relates generally to an appliance. More particularly, the present invention relates to an appliance with a Venturi based venting system.

Dual-cavity wall oven appliances typically draw in ambient or cooling air via air intakes located at the front of the appliance above the upper oven cavity or below the lower oven cavity. Additionally, each oven unit is typically cooled by a fan independently of the other oven unit. The fan can also be used to draw exhaust air out of the respective oven cavity. The fans may blow the air down the back of the oven units. The exhaust air for this type of system is usually evacuated at locations between the upper and lower oven units and also below the lower oven unit on the front side of the oven.

Moreover, typically the exhaust air passes through the fans before it exits the oven.

One disadvantage of the current oven design is that because the exhaust air passes through the fans, undesirable substances such as greases, moistures, etc. may accumulate on the fans, negatively affecting the fans' reliability and/or performance. Another disadvantage of the current oven design is that the use of multiple fans decreases the reliability, and increases the expense and complexity of such venting system. Yet another disadvantage of the current oven design is that the exhaust air, after heated by the oven units, contacts the fans. Such contact is undesirable as the heat from the exhaust air heats up the fans. The fans can be negatively affected as they are heated up beyond the optimal operational temperature range, which may lead to underperformance, damage or complete failure of the fans.

It would therefore be desirable to provide an appliance with a venting system wherein the undesirable exhaust air does not pass through the fans. It would also be desirable to provide an appliance with a venting system which uses a single fan to provide the venting power.

BRIEF DESCRIPTION OF THE INVENTION

As described herein, the preferred embodiments of the present invention overcome one or more of the above or other disadvantages known in the art.

One aspect of the invention relates to an appliance which includes a housing defining therein an airflow channel which is in flow communication with outside of the appliance, the airflow channel including a common channel comprising a diverging section; a first heating unit disposed in the housing, the first heating unit defining therein a first cavity; a second heating unit disposed in the housing, the second heating unit defining therein a second cavity; a first duct through which the first cavity is in flow communication with the common channel, the first duct having a first outlet end disposed at least partially in the diverging section; a second duct through which the second cavity is in flow communication with the common channel, the second duct having a second outlet end disposed in the diverging section; and a fan in flow communication with the common channel. When energized, the fan generates an airflow in the common channel to create a Venturi effect in the diverging section so that exhaust air in the first and second cavities is drawn into the common channel.

Another aspect of the invention relates to an appliance which includes a housing defining therein an airflow channel which is in flow communication with outside of the appliance, the airflow channel including a common channel with an intake end, an exhaust end and a diverging section between the intake end and the exhaust end; a first oven disposed in the housing, the first oven defining therein a first oven cavity; a second oven disposed in the housing, the second oven defining therein a second oven cavity; a first duct through which the first oven cavity is in flow communication with the common channel, the first duct having a first outlet end terminating in the diverging section; a second duct through which the second oven cavity is in flow communication with the common channel, the second duct having a second outlet end terminating in the diverging section; and a fan in flow communication with the common channel and disposed upstream of the first and second outlet ends. When energized, the fan generates an airflow in the common channel to generate a Venturi effect in the diverging section so that exhaust air in the first and second oven cavities is drawn into the common channel through the first and second ducts.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF INVENTION

Figure 1:
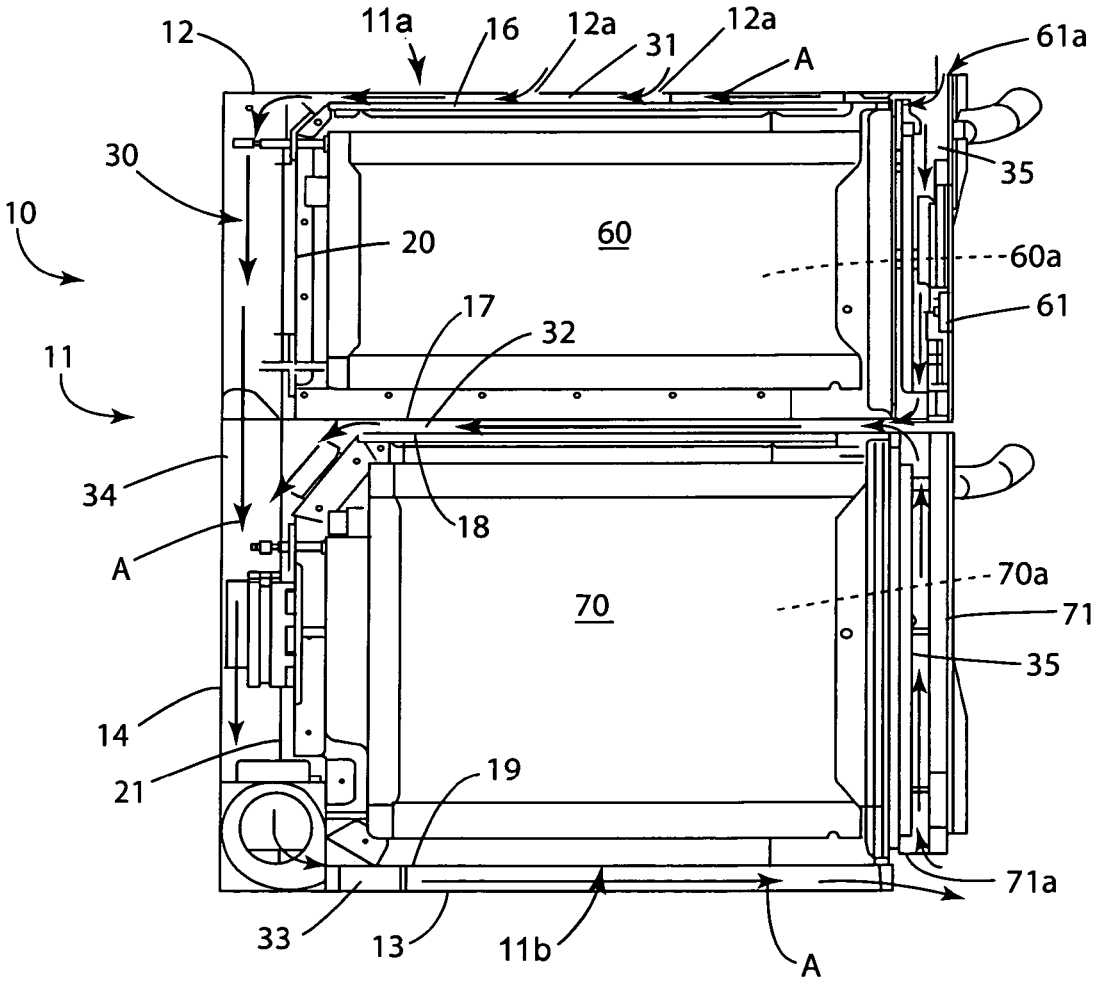
FIG. 1 is a schematic, cross sectional side elevational view of an exemplary dual-cavity oven incorporating an embodiment of a venting system of the present invention.
Figure 2:
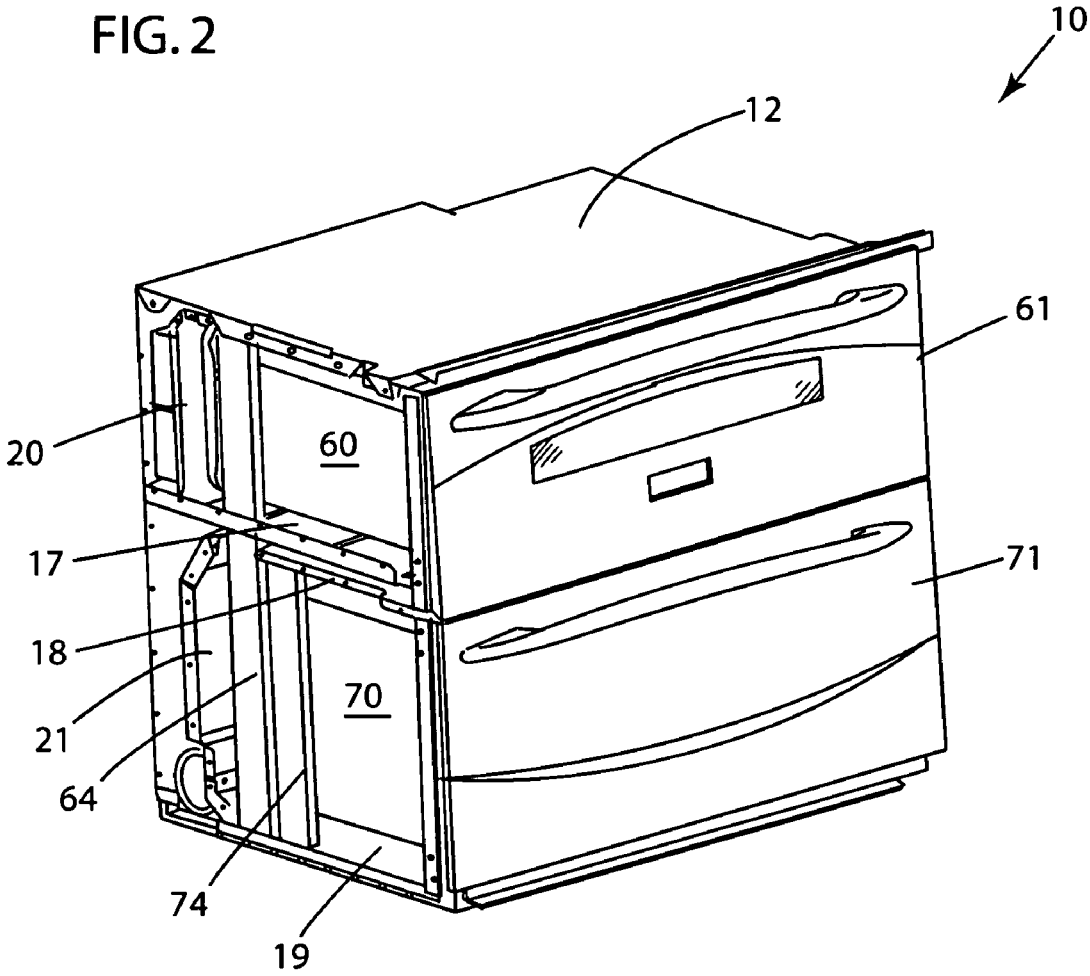
FIG. 2 is a perspective, partially cut-away view of the oven of FIG. 1, with some components of the oven being removed to show the first and second ducts.
Figure 3:
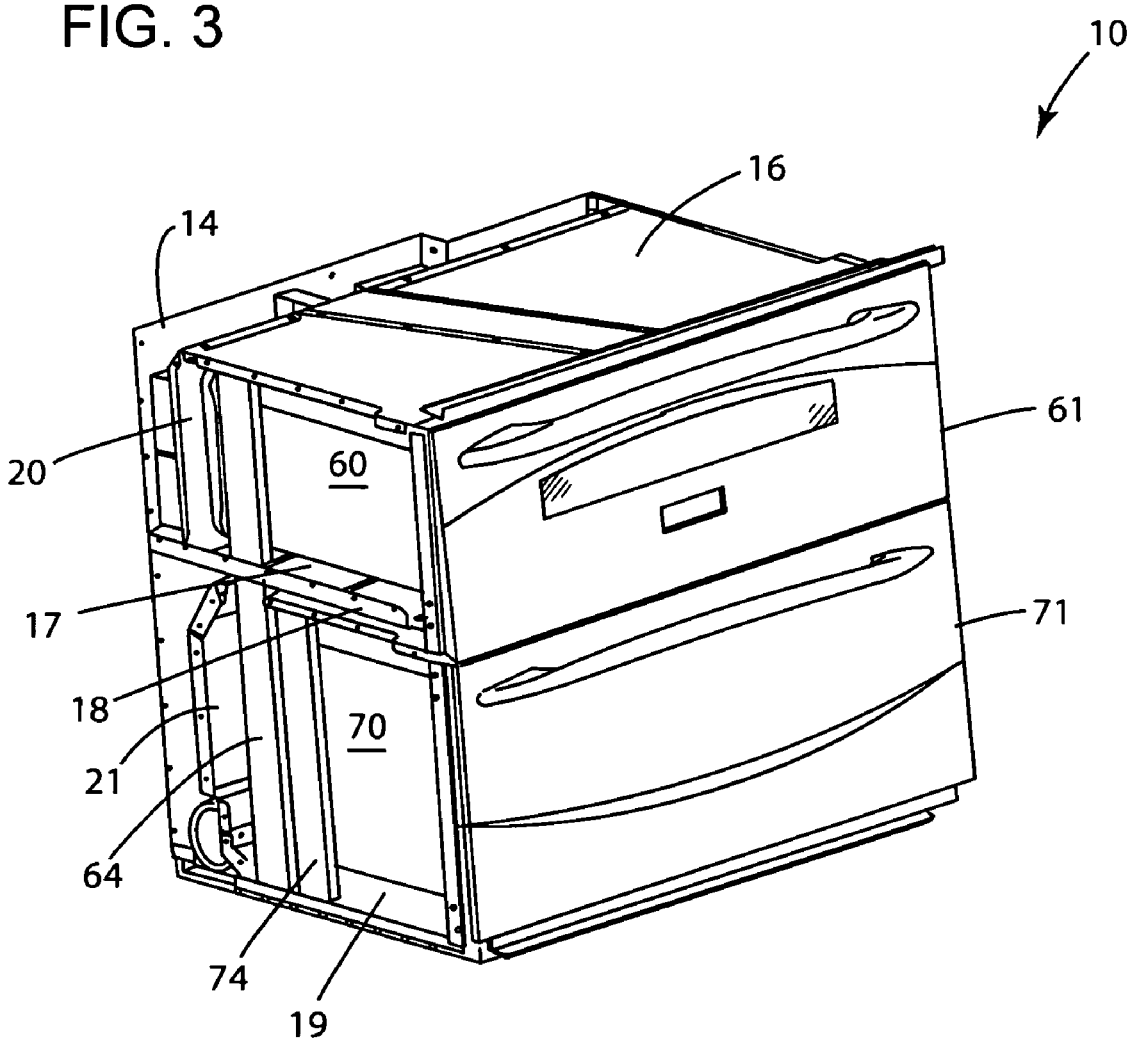
FIG. 3 is a perspective, partially cut-away view of the oven of FIG. 1, with the top wall being also removed.

Referring to FIGS. 1-7, an exemplary appliance such as a dual-cavity oven incorporating a preferred embodiment of a Venturi based venting system in accordance with the present invention is generally designated by reference numeral 10. The dual-cavity oven 10 has a housing 11 which includes an outer case 11*a* comprised of a top wall 12, a bottom wall 13, a back wall 14 and two sidewalls (not shown in FIG. 1).

Disposed in the housing 11 are a first heating unit such as a first oven 60 and a second heating unit such as a second oven 70, which is positioned below the first oven 60. The first oven 60 defines therein a first oven cavity 60*a* with a frontal opening (not shown). A first door 61 is pivotally attached to the housing 11 in a known manner for selectively closing the frontal opening of the first oven 60. Similarly, the second oven 70 defines therein a second oven cavity 70*a* with a frontal opening (not shown), and a second door 71 is pivotally attached to the housing 11 in a known manner for selectively closing the frontal opening of the first oven 70.

Figure 4:
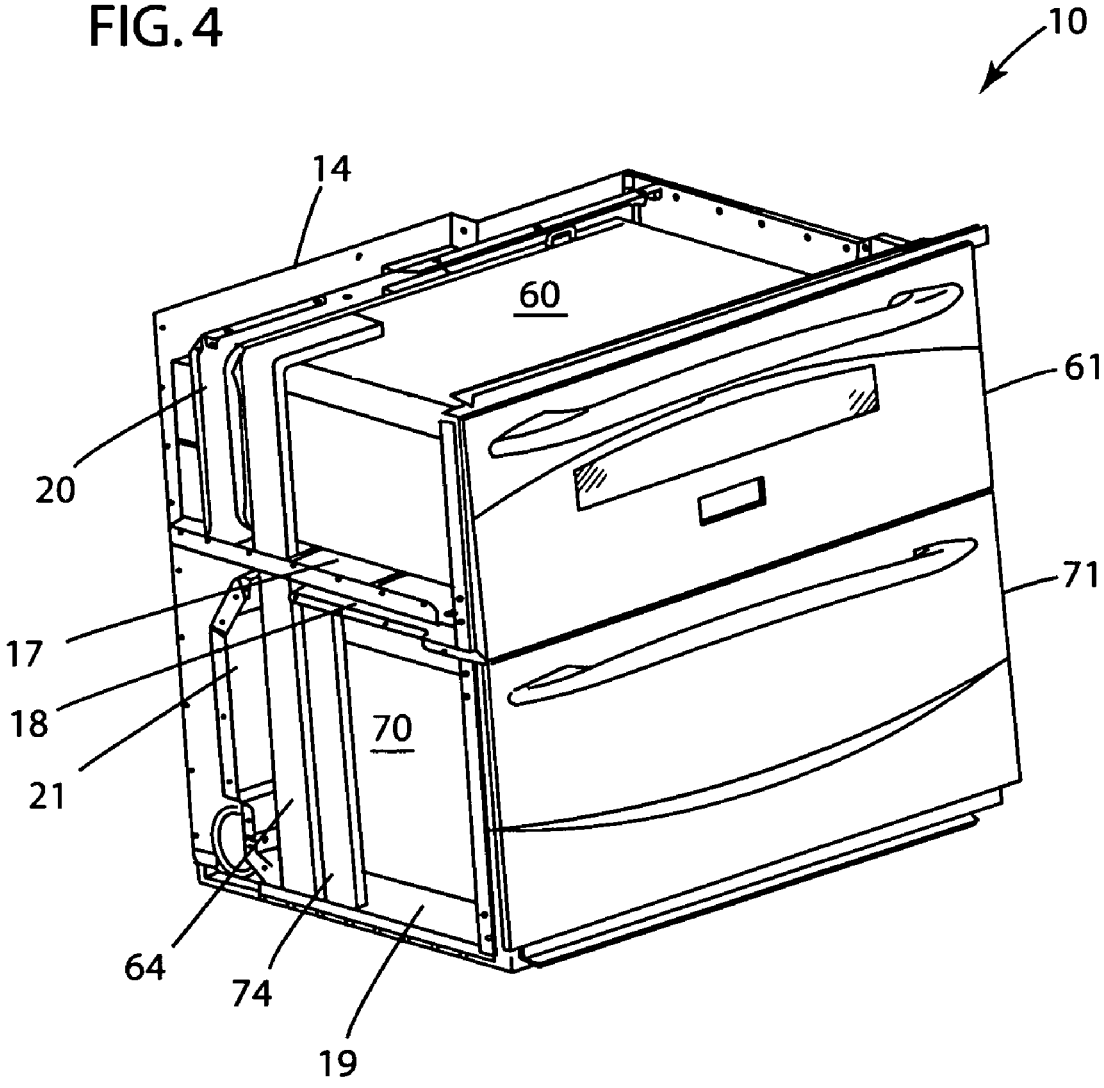
FIG. 4 is a perspective, partially cut-away view of the oven of FIG. 1, with the top insulation retention element and the insulation material for the upper oven being removed.
Figure 5:
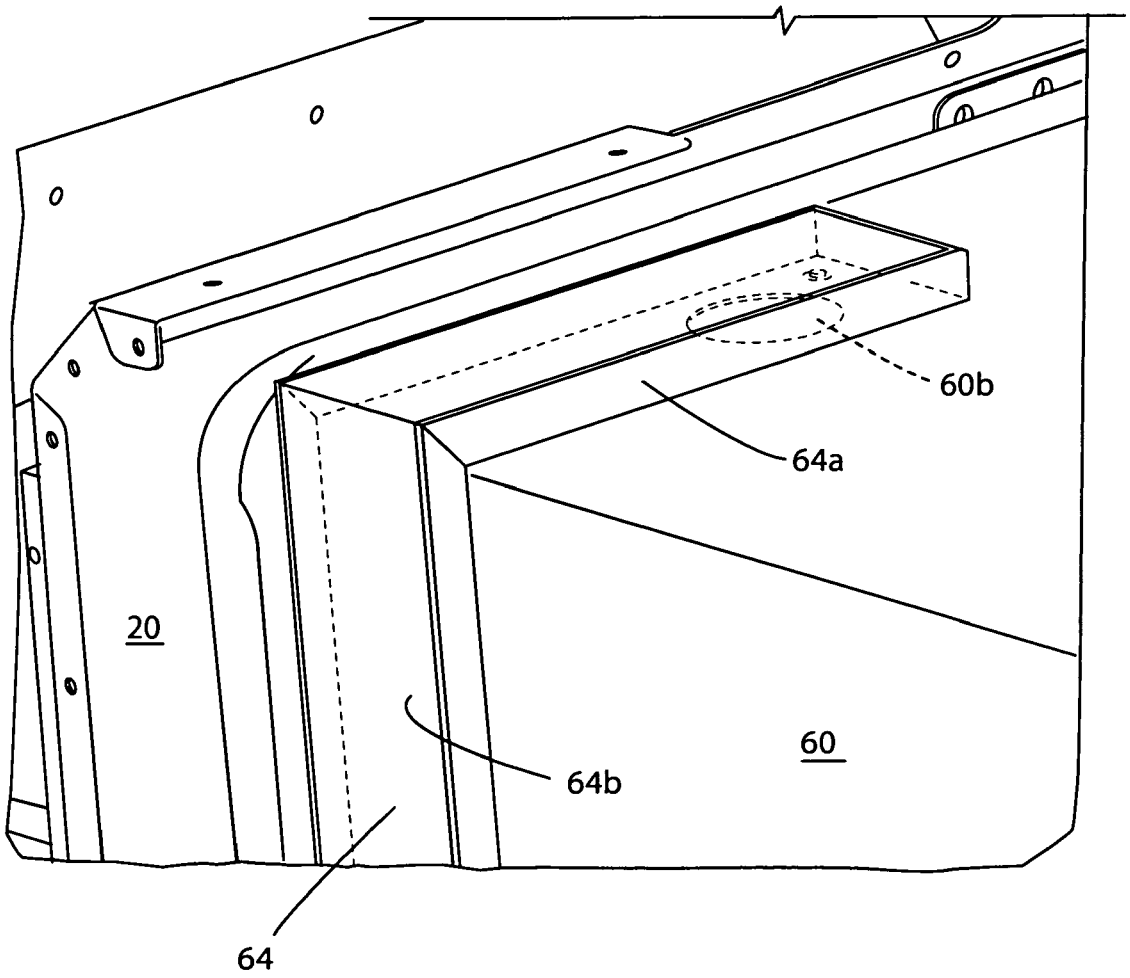
FIG. 5 is an enlarged, perspective, partially cut-away view of part of the oven of FIG. 1, showing the top section of the first duct in detail.
Figure 6:
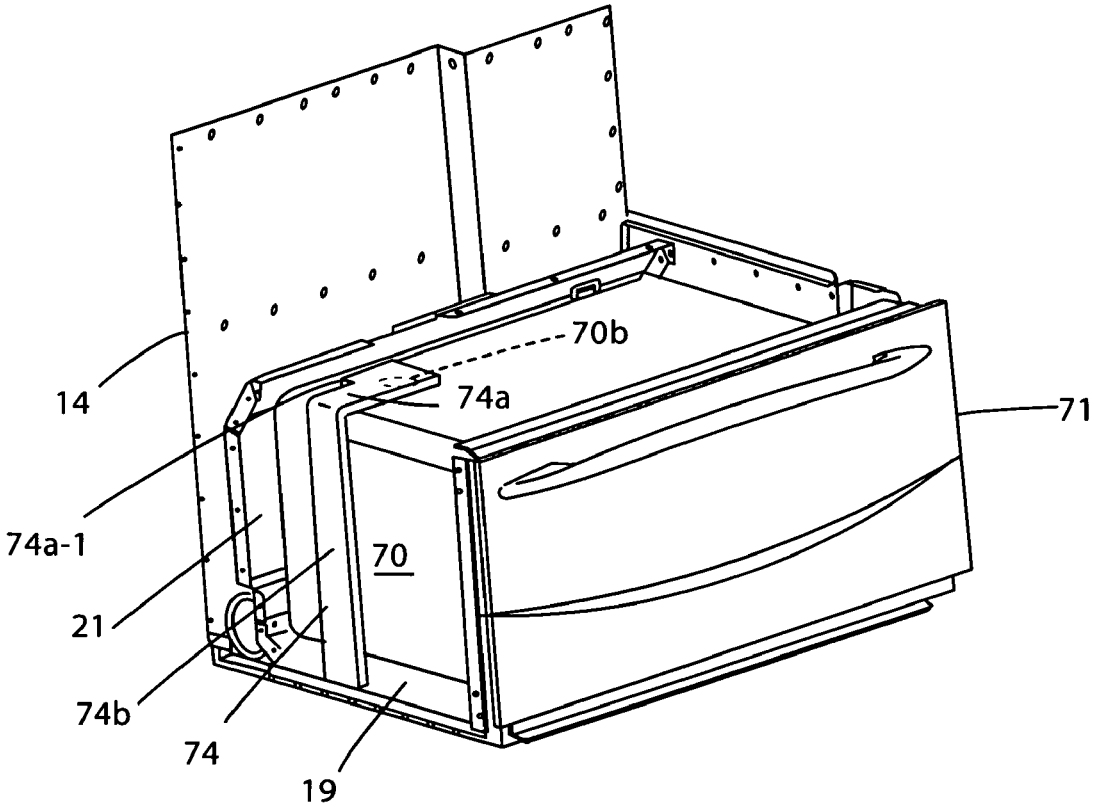
FIG. 6 is a perspective, partially cut-away view of the oven of FIG. 1, showing the lower oven unit and the second duct in detail.

The housing 11 also includes an inner case or insulation retention structure 11*b*. More specifically, as shown in FIGS. 1 and 4, the insulation retention structure 11*b* includes a first retention member 16 disposed between the top wall 12 and the first oven 60, a second retention member 17 disposed between the first and second ovens 60, 70, a third retention member 18 disposed between the second retention member 17 and the second oven 70, a fourth retention member 19 disposed between the bottom wall 13 and the second oven 70, a fifth retention member 20 disposed between the back wall 14 and the first oven 60, a sixth retention member 21 disposed between the back wall 14 and the second oven 70, and two side retention members (not shown in FIG. 1) each disposed between a respective sidewall of the outer case 11*a* and the first and second oven 60, 70. As is known in the art, the space defined between the insulation retention structure 11*b* and each of the first and second oven 60, 70 is preferably filled with a thermally insulating material such as fiberglass. The insulation retention structure 11*b* keeps the thermally insulating material in place.

As clearly illustrated in FIG. 1, the housing defines therein an airflow channel 30 which includes a first or top channel 31 defined by the top wall 12 and the first retention member 16, a second or middle channel 32 defined by the second and third retention members 17, 18, a third or bottom channel 33 defined by the bottom wall 13 and the fourth retention member 19, and a fourth or back channel 34 generally defined between the back wall 14 and the fifth and sixth retention members 20, 21. Preferably, the back channel 34 is in flow communication with the bottom channel 33 through a fan unit 90. Moreover, preferably, each of the doors 61, 71 defines therein an airflow channel 35 which is in flow communication with the middle channel 32. The top wall 12 has at least one air inlet 12*a*. The doors 61, 71 each have an air inlet 61*a*, 71*a*. When the fan unit 90 is energized, it creates a suction force within the airflow channel 30, which draws cooling air from the ambient into the airflow channels 30, 35 and moves it along the airflow channels 30, 35, as indicated by the arrow A in FIG. 1.

As shown in FIGS. 2-5, a first duct 64 is used to establish a flow communication between the first oven cavity 60*a* and a common channel 80 (shown in FIG. 8) defined in the lower channel 33. As clearly shown in FIGS. 4 and 5, the first duct 64 includes a first section 64*a* which covers an opening 60*b* formed on the top wall of the first oven 60 and extends outward laterally, and a second section 64*b* which extends downward, passing through the second, third and fourth retention members 17, 18, 19. Similarly, a second duct 74 is used to establish a flow communication between the second oven cavity 70*a* and the common channel 80. The second duct 74 includes a first section 74*a* which covers an opening 70*b* formed on the top wall of the second oven 70 and extends outward laterally, and a second section 74*b* which extends downward, passing through the third and fourth retention members 18, 19. Since the first and second ducts 64, 74 are positioned side by side and since preferably the openings 60*a*, 70*a* are aligned with each other, the first section 74*a* of the second duct 74 has a set back portion 74*a*-1.

Figure 7:
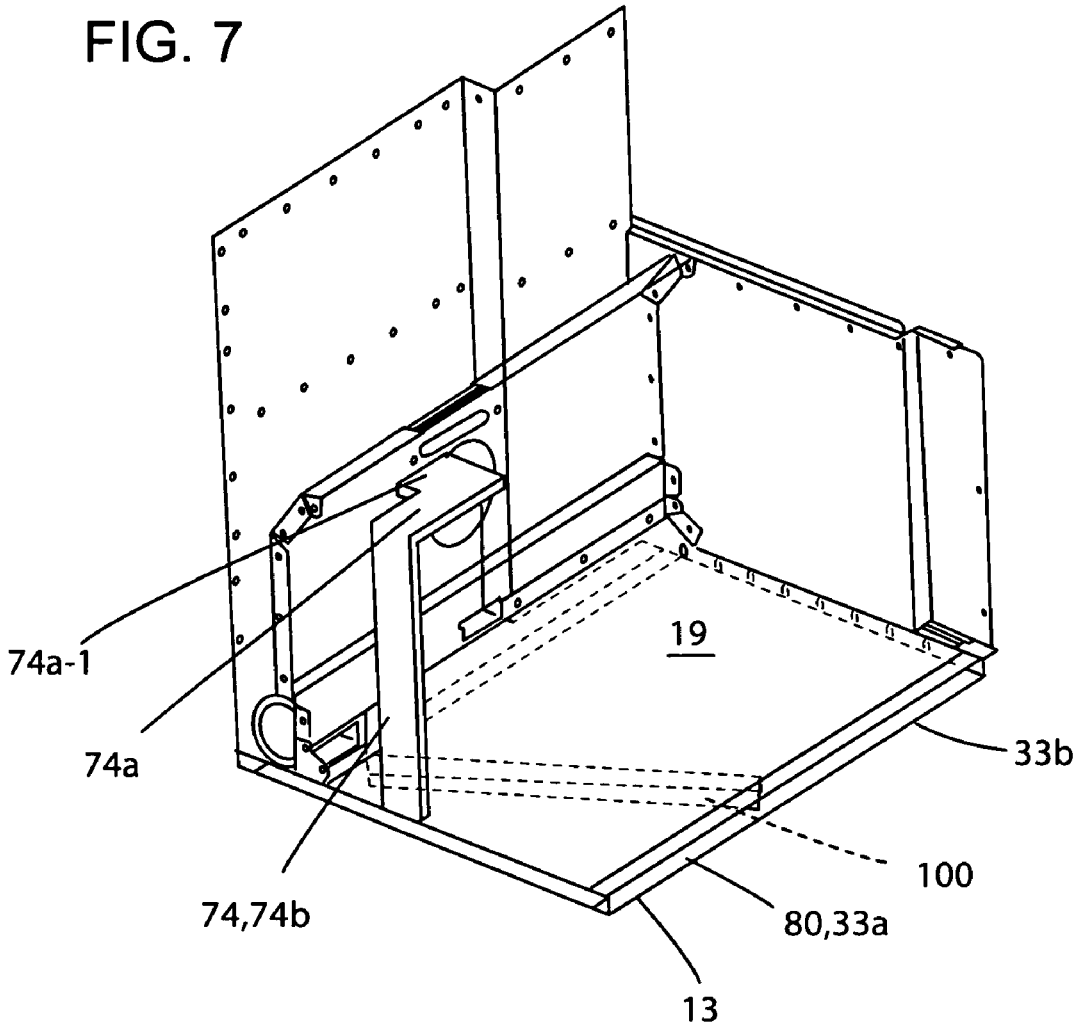
FIG. 7 is a perspective, partially cut-away view of the oven of FIG. 1, showing the second duct and the common channel in detail.
Figure 8:
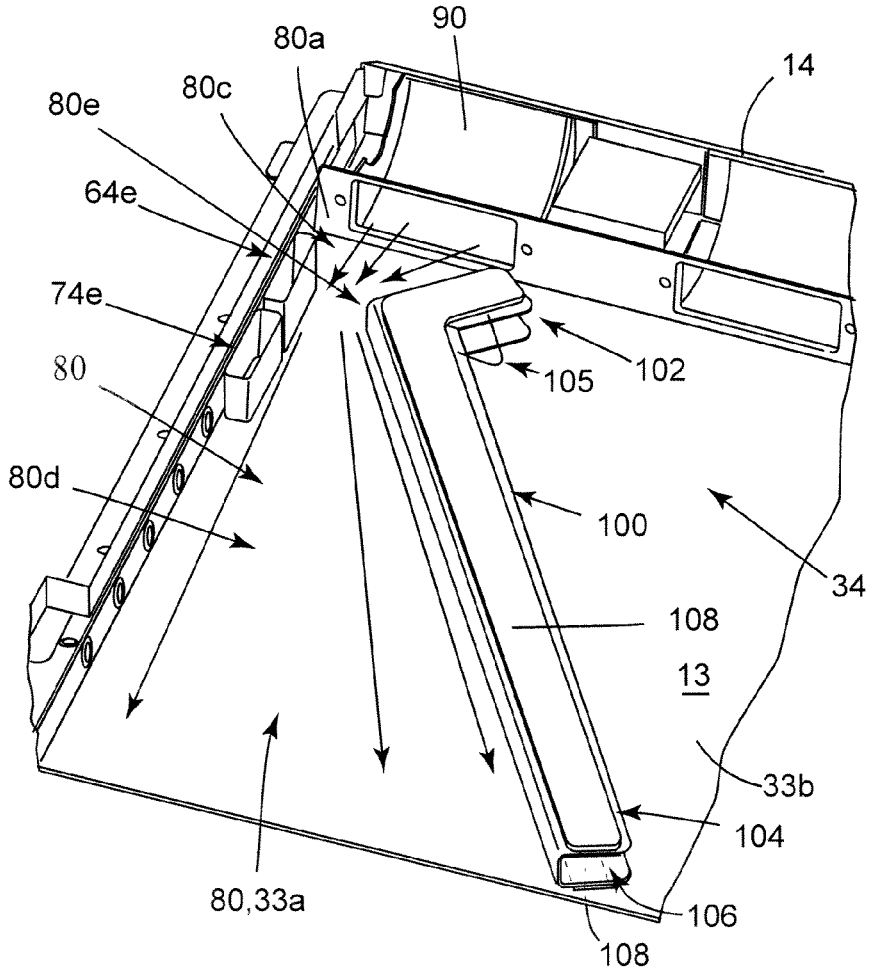
FIG. 8 is an enlarged, perspective, cut-away view of the oven of FIG. 1, showing the angular guide member and the bottom channel including the common channel in detail.

As clearly shown in FIGS. 7 and 8, the common channel 80 is defined in part by an angular guide member such as a Venturi guide member 100 which is positioned between the bottom wall 13 and the fourth retention member 19. More specifically, the guide member 100 divides the bottom channel 33 into a first section 33*a* which forms the common channel 80 and a second section 33*b*. The guide member 100 preferably includes a channel 106 facing away from the common channel 80. Other angular elements may be used as guide elements to generate a Venturi effect. As explained in detail below, the guide member 100 directs the airflow 84 in the common channel 80 in a substantially divergent pattern. Preferably, a sealing element 108 is disposed on each of the top and bottom surfaces of the guide member 100. The sealing element 108 is sandwiched by the guide member 100 and the bottom wall 13 and the fourth retention member 19.

As illustrated in FIG. 8, the guide member 100 is substantially V-shaped and has an angle 105 of less than 180 degrees. The angle 105 is formed by a first segment 102 and a second segment 104 and faces away from the common channel 80 so that the common channel 80 has a converging section 80*c* and a diverging section 80*d* disposed downstream of the converging section 80*c*. The common channel 80 thus is divided at the point of the "v" 80*e* of the guide member 100 where the converging section 80*c* and the diverging section 80*d* meet and where the common channel 80 has the smallest cross section. Preferably the first segment 102 is shorter than the second segment 104. The common channel 80 has an intake end 80*a* disposed adjacent to the back of the oven 10 and an exhaust end 80*b* disposed or terminating at the front of the oven 10.

Figure 9:
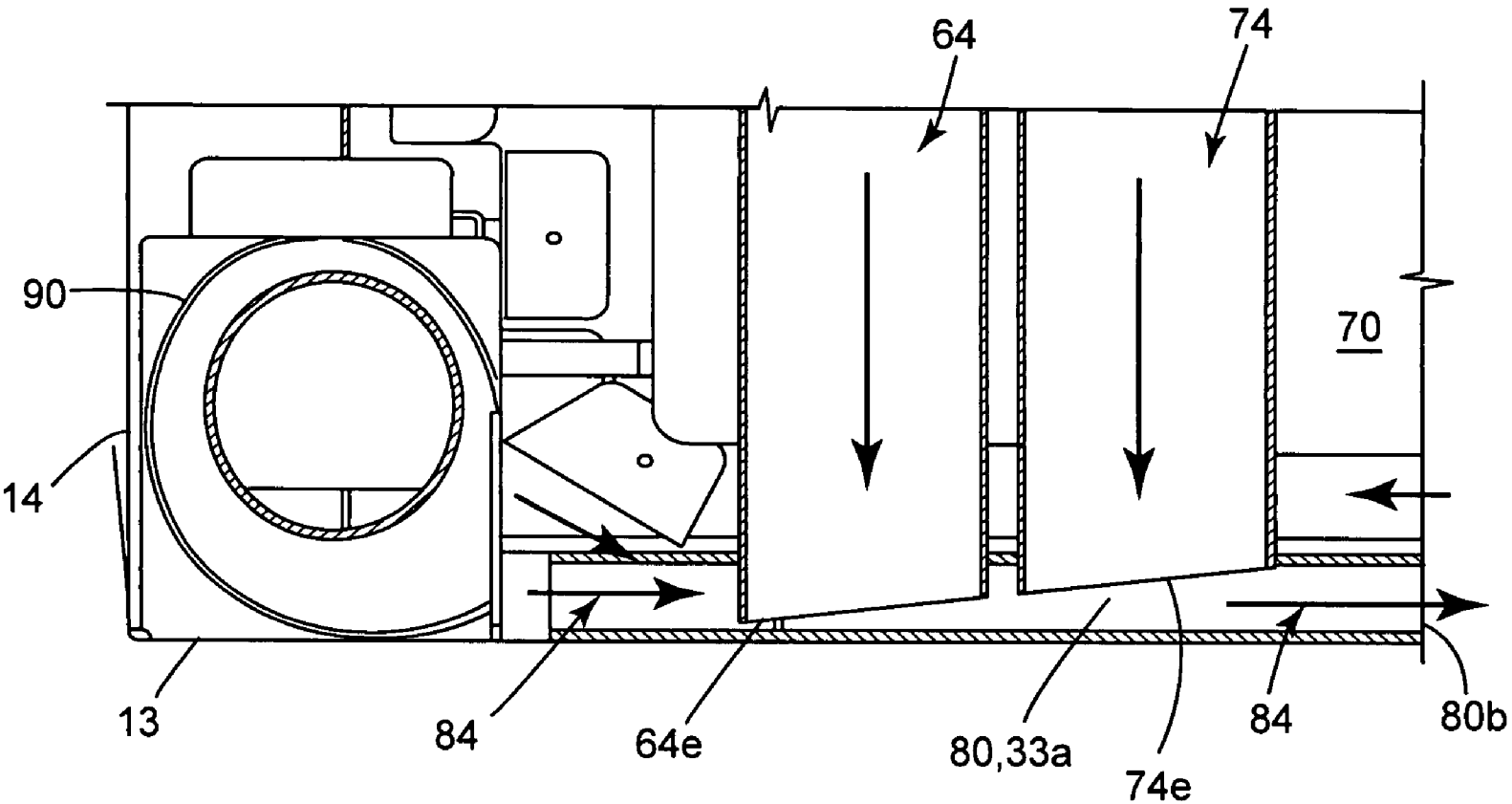
FIG. 9 is an enlarged, partially, cross sectional side elevation view of the bottom portion of the oven of FIG. 1.

Referring now to FIGS. 1, 8 and 9, the fan unit 90 is positioned in the lower, back portion of the oven 10, behind the first and second ducts 64, 74, and adjacent to the intake end 80*a* of the common channel 80. The term "fan" used herein covers electric fans, blowers, and other devices suitable for moving air. As shown in FIGS. 1, 7 and 8, the fan unit 90 is in flow communication with the back channel 34, the common channel 80 and the second section 33*b* of the bottom channel 33. The fan unit 90 actually has two fans, one for the common channel 80, the other for the second section 33*b* of the bottom channel 33. When energized, the fan unit 90 generates the airflow 84 in the common channel 80. The fan unit 90 is positioned upstream of the outlet ends 64*e*, 74*e* of the first and second ducts 64, 74. As explained in detail below, the airflow 84 is used to draw exhaust air from the first and second oven cavities 60*a*, 70*a* into the common channel 80 through the first and second ducts 64, 74, respectively.

As clearly shown in FIG. 9, the outlet ends 64*e*, 74*e* of the first and second ducts 64, 74 extend into the common channel 80. Each of the outlet ends 64*e*, 74*e* is angled such that the length of ducts 64 and 74 diminishes along the direction of the airflow 84. In other words, the outlet ends 64*e*, 74*e* are angled away from the fan unit 90 so that they do not facilitate the airflow 84 moving into the first and second ducts 64, 74. When the outlet ends 64*e*, 74*e* are adjacent to and aligned with each other along the direction of the airflow 84, preferably the angled bottoms of the outlet ends 64*e*, 74*e* are on a common plane.

Since the first duct 64 is longer than the second duct 74, its outlet end 64*e* is disposed upstream of the outlet end 74*e* of the second duct 74 so that its outlet end 64*e* is closer to the fan 90 than the outlet end 74*e*. Moreover, as clearly shown in FIG. 8, the outlet end 74*e* is disposed substantially in the diverging section 80*d*. However, preferably the upstream edge of the outlet end 64*e* is disposed directly across from the point of the "v" at 80*e* so that when the airflow 84 passes it, the airflow 84 has the fastest speed/velocity and therefore the lowest pressure at the upstream edge of the outlet end 64*e*. Alternatively, the outlet end 64*e* can be disposed partially in the diverging section 80*d* and partially in the converging section 80*c*.

When energized, the fan unit 90 generates the airflow 84 in the common channel 80. The airflow 84 has an initial speed/velocity and pressure at the intake end 80*a* of the common channel 80. As the airflow 84 passes through the converging section 80*c*, its speed/velocity increases while its pressure decreases. In contrast, as the airflow 84 passes through the diverging section 80*d*, its speed/velocity decreases while its pressure increases. The outlet ends 64*e*, 74*e* are positioned in the common channel 80 so that when the airflow 84 passes them, the low pressure in the channel resulting from the Venturi effect, is lower than the pressure inside the first and second oven cavities 60*a*, 70*a*. This creates a vacuum in each of the outlet ends 64*e*, 74*e* so that air is drawn from the first and second oven cavities 60*a* and 70*a* through the first and second ducts 64, 74, respectively. The combined airflow is then vented out of the oven 10 at the exhaust end 80*b*.

Thus, while there have shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a housing defining therein an airflow channel which is in flow communication with outside of the appliance, the airflow channel comprising a common channel, the common channel defining therein an airflow direction and comprising a diverging section with a cross section which increases in size in the airflow direction, and a converging section with a cross section which decreases in size in the airflow direction, the converging section being upstream of and next to the diverging section;

a first heating unit disposed in the housing, the first heating unit defining therein a first cavity;

a second heating unit disposed in the housing, the second heating unit defining therein a second cavity;

a first duct through which the first cavity is in flow communication with the common channel, the first duct comprising a first outlet end disposed at least partially in the diverging section;

a second duct through which the second cavity is in flow communication with the common channel, the second duct comprising a second outlet end disposed in the diverging section; and a fan in flow communication with the common channel, wherein when energized, the fan generates an airflow in the common channel to create a Venturi effect in the diverging section so that exhaust air in the first and second cavities is drawn into the common channel.

2. The appliance of claim 1, wherein the first duct has a length longer than a length of the second duct, the first outlet end being disposed upstream of the second outlet end.

3. The appliance of claim 1, wherein the housing comprises a bottom wall, the common channel being defined in part by the bottom wall.

4. The appliance of claim 3, wherein the housing further comprises a front, the common channel further comprising an exhaust end terminating at the front.

5. An appliance comprising:

a housing defining therein an airflow channel which is in flow communication with outside of the appliance, the airflow channel comprising a common channel, the common channel comprising an intake end, an exhaust end, a diverging section disposed between the intake end and the exhaust end and comprising a cross section which increases in size in a direction from the intake end to the exhaust end, and a converging section disposed between the intake end and the exhaust end and comprising a cross section which decreases in size in the direction from the intake end to the exhaust end, the converging section being upstream of the diverging section, the converging section and the diverging section meeting at a common line;

a first oven disposed in the housing, the first oven defining therein a first oven cavity;

a second oven disposed in the housing, the second oven defining therein a second oven cavity;

a first duct through which the first oven cavity is in flow communication with the common channel, the first duct comprising a first outlet end terminating in the diverging section;

a second duct through which the second oven cavity is in flow communication with the common channel, the second duct comprising a second outlet end terminating in the diverging section; and a fan in flow communication with the common channel and disposed upstream of the first and second outlet ends, wherein when energized, the fan generates an airflow in the common channel to generate a Venturi effect in the diverging section proximate the first and second outlet ends, so that exhaust air in the first and second oven cavities is drawn into the common channel through the first and second ducts.

6. The appliance of claim 5, wherein the first duct has a length longer than a length of the second duct, the first outlet end being disposed upstream of the second outlet end.

7. The appliance of claim 5, wherein the converging section and the diverging section are defined in part by an angular guide member.

8. The appliance of claim 7, wherein the guide member is substantially V-shaped.

9. The appliance of claim 7, wherein the housing comprises a bottom wall, the common channel being defined in part by the bottom wall, the guide element being supported by the bottom wall.

10. The appliance of claim 9, wherein the guide member is sandwiched by an insulation retention member for the second oven and the bottom wall, the guide member comprising a first surface facing the second oven, a second surface facing away from the second oven, and a sealing element disposed on each of the first surface and the second surface.

11. The appliance of claim 10, wherein the housing further comprises a front, the exhaust end terminating at the front.

12. The appliance of claim 5, wherein each of the first and second outlet ends extends into the common channel, at least one of the first and second ducts having a length which diminishes along a direction of the airflow.

13. The appliance of claim 12, wherein the housing comprises a back wall, the fan being disposed adjacent to the back wall.

14. The appliance of claim 13, wherein the fan comprises an outlet which is disposed adjacent to the intake end.

* * * * *